US007691446B2

(12) United States Patent
Irving et al.

(10) Patent No.: US 7,691,446 B2
(45) Date of Patent: Apr. 6, 2010

(54) HIGH TEMPERATURE SILICONE PROCESSING OF FUSER STRUCTURE

(75) Inventors: David C. Irving, Avon, NY (US); Daniel L. Coughlin, Elba, NY (US); Patrick Finn, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 221 days.

(21) Appl. No.: 11/879,153

(22) Filed: Jul. 16, 2007

(65) Prior Publication Data

US 2009/0022897 A1 Jan. 22, 2009

(51) Int. Cl.
*B05D 3/02* (2006.01)

(52) U.S. Cl. ..... 427/372.2; 427/374; 427/379; 427/384; 428/36.8; 428/36.9; 428/313.9; 428/327; 428/421; 428/447

(58) Field of Classification Search ..... 427/472, 427/372; 428/36.8
See application file for complete search history.

(56) References Cited

U.S. PATENT DOCUMENTS 5,709,949 A * 1/1998 Chen et al. ..... 428/421
5,906,881 A * 5/1999 Chen et al. ..... 428/141
7,008,678 B2 * 3/2006 Chen et al. ..... 428/36.8

* cited by examiner

*Primary Examiner*—Nadine Norton
*Assistant Examiner*—Maki Angadi
(74) *Attorney, Agent, or Firm*—James J. Ralabate

(57) ABSTRACT

This is a process to restore compression set properties of a silicone rubber fuser structure that has been damaged during the coating of the silicone with Teflon; Teflon is a registered trademark of DuPont. This restoration is achieved by re-baking the coated fuser roll at temperatures of 175° C. to 275° C. This will improve the compression set and will give the fuser structure improved life and provide better image quality.

5 Claims, 1 Drawing Sheet

HIGH TEMPERATURE SILICONE PROCESSING OF FUSER STRUCTURE

This invention relates to electrostatic marking systems and, more specifically, to a process for making a fuser element useful in said marking system.

BACKGROUND

Generally, in a commercial electrostatographic marking or reproduction apparatus (such as copier/duplicators, printers, multifunctional systems or the like), a latent image charge pattern is formed on a uniformly charged photoconductive or dielectric member. Pigmented marking particles (toner) are attracted to the latent image charge pattern to develop this image on the dielectric member. A receive member, such as paper, is then brought into contact with the dielectric or photoconductive member and an electric field applied to transfer the marking particle developed image to the receiver member from the dielectric member. After transfer, the receiver member bearing the transferred image is transported away from the dielectric member to a fusion station and the image is fixed or fused to the receiver member by heat and/or pressure to form a permanent reproduction thereon. The receiving member passes between a pressure roll and a heated fuser roll or element.

Sometimes copies made in Xerographic or electrostatic marking systems have defects caused by improper fusing of the marking material or the fuser itself. The incomplete fusing can be the result of many factors such as defects in the toner pressure or fuser rolls. Defects in the fuser rolls can be caused by improper compression set properties resulting from extended use or improper coating of the fuser substrates during manufacture.

A electrographic fuser element includes metallic substrate such as aluminum, an elastomeric cover layer, usually a silicone, and at least one coating over the silicone, generally made of a fluoropolymer such as Teflon (a trademark of DuPont).

This invention and its various embodiments are concerned with the manufacturing process for making these coated fuser elements including fuser rolls and other configurations. While for clarity the term "fuser structure or member" will be used throughout this disclosure and claims, any suitable fusing configurations are intended to be included, such as rolls, belts, and pressure members.

As above noted, fuser rolls used in electrostatographic marking systems generally comprise a metal core cylinder coated with one or more elastomer layers such as silicone. Conventional fuser roll core cylinders are relatively thick walled aluminum alloy cylinders. Such thickness has been desired in order to provide strength and durability as the fuser roll presses against the nip of the adjoining compression or pressure roll. For a 35.00 mm outside diameter fuser roll core, a thickness of 1.5 to 8 mm is fairly standard. Similar dimensions are common in office and production printing systems capable of imaging more than 50 pages per minute. In most embodiments, the fuser roll is provided an outer non-stick surface or covering of polytetrafluoroethylene known as Teflon, a trademark of E.I. DuPont. The Teflon coating can be of any suitable thickness usually on the order of several mils.

The use of a fusing member constructed with a non-stick material as a top layer and a heat resistant base layer has been known in the electrostatographic art. Typical non-stick materials that may be used include polytetrafluoroethylene (PTFE), fluorinated ethylene propylene (FEP), perfluoroalkoxy (PFA), polychlorotrifluoroethylene (ECTFE), ethylene-chlorotrifluoroethylene (ECTFE), ethylene-chlorotrifluoroethylene (ECTFE), ethylene-tetrafluoroethylene (ETFE), polyvinylidene fluoride (PVDF) and polyvinyl fluoride (PVF), and blends of these materials.

Fluoropolymer resin by itself, though an excellent non-stick material, is not compliant. Silicone compounds, on the other hand, are compliant. It is known in the art form a fuser member having a material combining the non-stick properties of fluoropolymer resins and the compliant properties of silicone elastomers.

Currently, there are two approaches for making Teflon over silicone fuser members. The first approach is to mold the rubber in between the substrate and the fluoro-plastic sleeve, the other method coats the fluoro-plastic on the silicone and cures it on the silicone. The latter method is preferred because of improved durability and wear. The coating method typically involves the following process: a substrate is primed, silicone rubber is molded, cured and optionally post cured; the required dimension is usually obtained by grinding; the fluoropolymer layers are applied usually by spraying; the whole member is baked above the melting or sintering point (300 C) of the fluoropolymer, then the cured surface is usually polished. The fluoropolymer coating layers typically comprise an adhesive (often silane) and/or polyimide/polyamide coating, an optional fluoropolymer primer layer, an optional mid coat layer and a topcoat fluoropolymer layer that is in contact with the media and toner.

There are several advantages to the latter approach. The fluoropolymer layer can be made thinner than a sleeve, less than the ~30 μm thick with a tight distribution. Also, there is more choice in the material that can be applied. This configuration has been shown by machine testing to yield a more durable and therefore a longer lived fuser member than the sleeved approach by better resisting damage from paper; stripper fingers or sensors that contact the member.

A problem with this approach is that silicone is degraded at high temperatures, →260° C. while the fluoro-plastic coating develops its best properties when baked in the 370° C. to 400° C. range. There is a delicate balance between under-curing the Teflon which can result in poor wearing components or overheating the silicone and damaging it. The latter condition will cause it to take a set easily when in contact with the pressure roll, stripper fingers or other components causing a PQ defect. In fact, both of these failure modes have been observed indicating there is not sufficient process latitude or process control.

The temperatures required to bake the fluoropolymer layer in a Teflon over silicone system (TOS) damages the properties of the silicone rubber, specifically the compression set properties to the point where set of the member is often seen in the form of flat spots or finger-induced dents. Currently, one may process at a temperature lower than that preferred for Teflon cure to improve set properties at the expense the Teflon properties (primarily wear); the result is degraded life due to occasional poor wear or set. Alternately, the TOS member may be "Molded in Place", MIP, where silicone rubber is molded in between an extruded Teflon sleeve and substrate. This approach has the disadvantage of a relatively thick fluoropolymer layer with wider dimensional tolerances and less durability.

SUMMARY

This invention provides a process to restore the compression set properties of a silicone rubber member that has been diminished or damaged by high temperature during the first heating and curing step used in the process to coat the Teflon over the silicon. The recovery of at least some compression properties is achieved by re-heating or re-baking the entire coated roll at temperatures between ~175° C. and 275° C. after the coating has been cured in the first heating and curing step. This process has shown improvement in elastomer compression set of 50% or more. This re-heat approach will result in improved life and improved copy quality. Excellent results were obtained when the re-baking was conducted at about 220 to 240° C.

In one embodiment, the present disclosure is directed to a method for re-heating a fuser structure after the first heating and curing step to adhere a fluoropolymer layer to a silicone layer. The first heating and curing step or method comprises applying an aminosilane adhesive to the silicone layer that is first coated on a metallic substrate and applying a fluoropolymer layer containing fluoropolymer and at least one of polyamide-imide or polyamide over the aminosilane adhesive. In one embodiment, at least one additional fluoropolymer layer is formed over the fluoropolymer layer containing fluoropolymer and at least one of polyamide-imide or polyamide. The additional fluoropolymer layers may or may not contain a polyamide-imide and/or a polyamide. In some embodiments of the first heating and curing step, at least the outer fluoropolymer layer does not contain a polyamide-imide and/or a polyamide. In other embodiments, none of the additional fluoropolymer layers contain a polyamide-imide and/or a polyamide.

In some embodiments, the silicone layer consists of silicone. Alternatively, the silicone layer may comprise components other than silicone. In embodiments, the silicone layer contains at least 50 volume percent silicone, preferably at least 70 volume percent silicone, depending on thermal conductivity requirements.

Fluoropolymers that may be used in the first heating and curing step include, but are not limited to, polytetrafluoroethylene, polymers of chlorotrifluoroethylene, fluorinated ethylene-propylene polymers, polyvinylidene fluoride and hexafluoropropylene. The one of more additional fluoropolymer layers may consist of fluoropolymer. Alternatively, these fluoropolymer layers may contain components other than fluoropolymers. In embodiments, these fluoropolymer layers contain at least 70 volume percent fluoropolymers, depending on electrical conductivity, wear and release requirements.

There are a multitude of fluoropolymer type materials that may be used. Two typical examples are both three part systems that are commercially available from DuPont. The first is a non-electrically conductive system which is 855N-021, 855N-401 and 855N-500. The second is an electrically conductive system which is 855N-023, 855N-101 and 855N-103. Three part systems are not the only methodology and coating systems can range from one to a multitude of coats.

As above noted, embodiments of this invention comprise a process that improves the compression set of a composite silicone component after it has been initially damaged by high temperature during the first heating and curing step or coating process. As above noted, this is accomplished by re-heating the component at a temperature of about 175° C. to 275° C. after it has been exposed to the damaging fluoropolymer cure cycle. Depending on the duration of the bake, the compression set can be reduced by up to ½ or more. This invention will enable the use of the durable fluoropolymer coatings while maintaining the compression set required for constant engagement fusing systems thereby improving fuser roll life. Alternately, in systems with wear out failure modes, the invention could be used to advantage by increasing the fluoropolymer bake temperature/time to achieve a more durable/wear resistant coating while still meeting set requirements. This improved wear performance will substantially improve life of the fuser component.

Some prior art patents which disclose typical fuser member construction are U.S. Pat. Nos. 5,319,427; 5,720,703; 5,998,034 and 5,547,759. All of these disclose a fuser member having an outer fluoropolymer coating over an elastomeric base layer and teach production methods of forming these fuser members. The present invention comprises a re-heat step that can be used with the processes disclosed by the above patents, if suitable, after the above production methods to enhance or recover desirable compression properties that may have been lost during these production methods. These production methods and others will be referred to herein as a "first heating and curing step" or "first temperature" used.

The present embodiments include improving or recovering the compression set of fuser structures including fuser rolls. However, the present disclosure also includes fuser members that are not rollers such as fuser belts, as well as other layered structures comprising a silicone layer, an adhesive layer and a fluoropolymer layer.

In some embodiments in the first heating and curing step, at least one additional fluoropolymer layer is applied. In some embodiments, at least two additional fluoropolymer layers are applied. In particular, both a mid-coat and a top-coat are preferably applied. Mid and top-coats that may be used are described in U.S. Pat. No. 5,998,034 to Marvil et al which is herein incorporated by reference in its entirety. Each of the fluoropolymer layers may or may not be dried before the next fluoropolymer layer is applied.

After spraying the various layers, the liquid-coated roll may be cured using an infrared oven. The upper limit of the cure temperature may be determined by the temperature at which the silicone layer and/or the aminosilane adhesive layer begin to break down.

After completion of the first heating and curing step, roll is re-heated at a temperature of 175° C. to 275° C. to restore at least some compression properties lost during the prior disclosed curing temperature.

Compression set is a common measure of permanent deformation of a material, ASTM D395 B. In this case, lower compression set is better since items in contact with the coating such as mating rolls, stripper fingers, media, temperature-sensing devices and the like will leave smaller or no artifacts on the surface to then show up in the prints as gloss variation or loss of fix.

The compression set procedure used to evaluate the present samples is very similar to ASTM D395 B with constant deflection. The silicone "buttons" were coated with fluoroplastic before being subjected to the test to better simulate our use of coatings in fuser members. Specifically, the silicones are given a post cure, typically for 4 hour at 400° F. The buttons were coated with DuPont 855-021 primer; 855-401 Midcoat and/or 855-500 topcoat. The samples are then subjected to fluoroplastic cure in a forced air oven so that the button is at the specified temperature for approximately 20 minutes. The cured samples were then subjected to the Post Cure Bake at a temperature and time as specified in the data. The initial thicknesses were taken and then the sample aged at 200° C. for the time specified, 23 or 24 hours. The thickness loss compared to the original compression is the "compression set".

Compression set testing is used to determine the ability of elastomeric materials to maintain elastic properties after prolonged compressive heating stress. The test measures the somewhat permanent deformation of the specimen after it has been exposed to compressive stress for a set time period. This test is particularly useful for applications in which elastomers would be in a constant pressure/release state.

Test Procedure: The thickness of the original specimen is measured. The specimen is then placed between spacers and in the compression device. The specimen is compressed to 25% of its original height using spacers to accurately measure the compression. Within two hours of assembly, the compression device is placed in an oven at a specified temperature for the suggested time periods of 22 hours and 70 hours. After removing the sample from the oven, the specimen is allowed to cool for 30 minutes before measuring the final thickness.

Specimen size: There are 2 cylindrical disk specimen sizes: Type 1—Thickness is 12.5 mm=/−0.5 mm; Diameter is 29.0 mm=/−0.5 mm; Type 2—Thickness is 6.0 mm=/−0.2 mm, Diameter is 13.0 mm=/−0.2 mm.

Data: Compression set is expressed as a percentage of the original deflection. $C_B$=[(to−ti)/to−tn)]×100

$C_B$=Compression set to=Original thickness of the specimen

Ti=Final thickness of the specimen; tn=thickness of the space bars used.

To summarize, embodiments of this invention provide the use of a specific secondary reheating or re-baking process to restore compression set properties of silicone rubber in Teflon® over silicone (TOS) fuser rolls. As above noted, during manufacture of TOS rolls in a first heating and curing step or process, a high temperature is used to melt and flow the Teflon on the surface of the silicone giving a smooth continuous coating. However, the temperature required to adequately flow Teflon is damaging to silicone. This leaves the silicone with a lower compression set, yielding short life or bad copy quality. After this first heating and curing step, a re-bake of about 175°-275° C. restores as much as 50% of the compression set present before the damage occurred. Time of this re-bake depends upon the specific silicone used, the Fluoro polymer bake temperature used and the compression set required by the application. This improved compression set could be occurring because of the rebuilding of bonds (that were destroyed by the Teflon cure temperature) in the secondary bake.

If the compression set properties of the silicone coating that are damaged are allowed to stay, the resulting copies from the marking system will be of a very low quality and the useful life of the fuser element can be adversely affected.

DETAILED DESCRIPTION OF THE DRAWINGS

Figure 1:
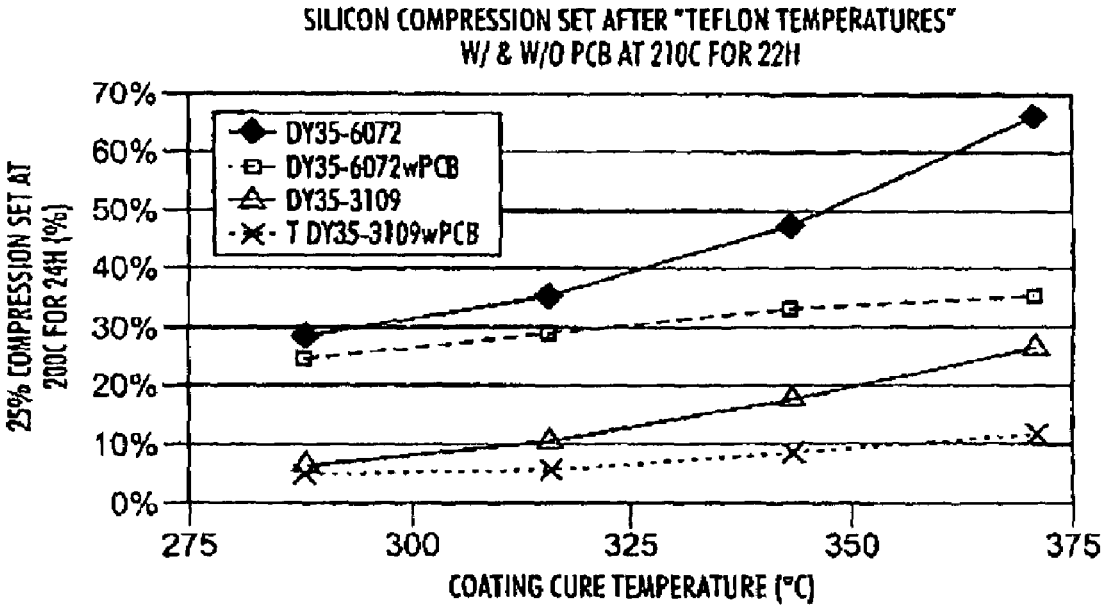
FIG. 1 (Graph A) illustrates results from baking silicone rubber at temperatures indicated.

In FIG. 1 graph A, the solid line shows the high compression set that results from baking silicone rubber at the temperatures required by our preferred Fluoro polymer coatings. The dashed line shows the reduced compression set from Post Cure Baking of the silicone at 210° C. for 22 hours.

Figure 2:
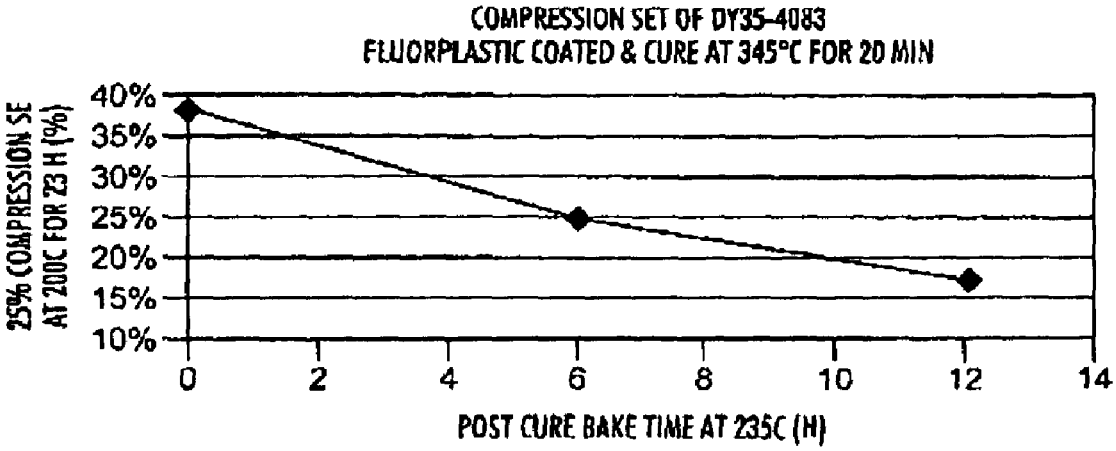
FIG. 2 (Graph B) illustrates the length of time the silicone is subject to baking.

FIG. 2 graph B shows the importance of the length of time the "damaged silicone" is subjected to the post bake cycle. While improvement in compression set may continue over time, 24 hours is about the practical limit for our purposes, with a 18 h or less bake being sufficient for most of our applications.

The first graph A (FIG. 1) shows the compression set for two silicone materials with the fluor-polymer layer cured at different first bake and cure temperatures. The dotted lines show the improvement in compression set with a second bake of 210 C for 22 hours.

In summary, the present embodiments provide a method for the production of a fuser structure which comprises providing a metallic substrate, coating the substrate with an elastomer, providing the elastomer with a fluoropolymer coating in a first heating and curing step, heating and curing the resulting fuser structure at a first temperature above a melting point of the fluoropolymer and subsequently after the curing re-heating the resulting fuser structure to a second temperature of about 175° C.-275° C. The metallic substrate is an aluminum substrate in one embodiment and the elastomer is a silicone material. The fluoropolymer is a member selected from the group consisting of polytetrafluoroethylene, perfluoroalkoxy, polymers of chlorotrifluoroethylene, fluorinated ethylene-propylene polymers, polyvinylidene fluoride, hexafluoropropylene and combinations thereof. The first temperature in an embodiment is about 300° C. to about 400° C. Heating to the second temperature is provided to at least partially restore any compression properties in the elastomer that may have been diminished by the curing step.

In another embodiment, a method is provided for the production of a fuser structure useful in electrostatic marking systems. The method comprises providing a metallic substrate, priming the substrate by dipping, wiping, brushing or spraying and adhesive coating the substrate with an elastomer material and subsequently curing the elastomeric material on the substrate and applying a fluoropolymer layer or coating onto the elastomer. The fluoropolymer is applied by a spraying, flow coating, dip coating or a ring coating technique in a first heating and curing step, heating a resulting structure at a first temperature above the melting point of the fluoropolymer, then subsequently reheating the resulting structure to a second temperature of about 175° C. to 275° C.

In this method, the fluoropolymer is a material selected from the group consisting of polytetrafluoroethylene, perfluoroalkoxy, polymers of chlorotrifluoroethylene, fluorinated ethylene-propylene polymers, polyvinylidene fluoride, hexafluoropropylene and any mixtures thereof, and wherein the first temperature is about 300° C. to about 400° C. The heating to second temperature is provided to at least partially restore any compression properties in the elastomer that may have been diminished by the curing step.

Best results were obtained in an embodiment where a method is used for the production of a fuser structure including a roll for use in an electrostatic marking system. This method comprises providing a tubular aluminum substrate, priming the substrate with an adhesive where a silicone elastomer is coated over the adhesive, a fluoropolymer is spray, flow, dip or ring coated over the silicone elastomer to form a resulting coated tubular structure. The structure is then baked in a first heating and curing step to a first temperature of about 300° C. to about 400° C., permitting the structure to cure and cool and subsequently reheating the structure to a second temperature of about 175° C. to about 275° C. This reheating is continued until at least some compression properties of the silicone elastomer that were diminished by the first temperature are at least partially restored. In this embodiment, the adhesive is selected from the group consisting of a silane, a polyimide, a polyamide or mixtures thereof.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for the production of a fuser structure including a roll for use in an electrostatic marking system, said method comprising:

providing a tubular aluminum substrate, priming said substrate with an adhesive, coating a silicone elastomer over said adhesive, coating a fluoropolymer over said silicone elastomer to form a resulting coated tubular coated structure, said structure is then baked in a first heating and curing step to a first temperature of about 300° C. to about 400° C. thereby diminishing at least some compression properties of said silicone elastomer, permitting said structure to cure and cool, subsequently re-heating said coated tubular structure to a second temperature of about 175° C. to about 275° C., said re-heating continued until at least some said compression properties of said silicone elastomer that were diminished by said first heating and curing step temperature are at least partially restored.

2. The method of claim 1 wherein said adhesive is selected from the group consisting of a silane, a polyimide, a polyamide or mixtures thereof.

3. The method of claim 1 wherein after said first heating, said re-heating to about 175° C. to 275° C. restores up to about 50% of a compression set that were present before said first heating.

4. The method of claim 1 wherein said fluoropolymer is a material selected from the group consisting of polytetrafluoroethylene, perfluoroalkoxy, polymers of chlorotrifluoroethylene, fluorinated ethylene-propylene polymers, polyvinylidene fluoride and hexafluoropropylene, and combinations thereof.

5. The method of claim 1 wherein said re-heating is conducted at a temperature of about 220° C. to 240° C.

* * * * *